US009516906B1

(12) United States Patent
Wiggins

(10) Patent No.: US 9,516,906 B1
(45) Date of Patent: Dec. 13, 2016

(54) SPECIAL FLUSHABLE DISPOSABLE GLOVES SYSTEMS

(71) Applicant: Trudy Wiggins, Marshall, TX (US)

(72) Inventor: Trudy Wiggins, Marshall, TX (US)

( * ) Notice: Subject to any disclaimer, the term of this patent is extended or adjusted under 35 U.S.C. 154(b) by 0 days.

(21) Appl. No.: 14/243,565

(22) Filed: Apr. 2, 2014

Related U.S. Application Data

(60) Provisional application No. 61/814,451, filed on Apr. 22, 2013.

(51) Int. Cl.

| | |
|---|---|
| ***A45D 24/00*** | (2006.01) |
| ***A45D 7/00*** | (2006.01) |
| ***A41D 19/00*** | (2006.01) |
| ***B65D 85/18*** | (2006.01) |
| *B65D 83/08* | (2006.01) |

(52) U.S. Cl.
CPC ..... *A41D 19/0055* (2013.01); *B65D 85/18* (2013.01); *B65D 83/0847* (2013.01)

(58) Field of Classification Search
CPC .. A41D 19/01; A41D 19/01529; A41D 19/00; A41D 19/04; A41D 19/0055; A47K 10/424; A47K 10/185; B65D 85/18; B65D 83/0847
USPC ..... 2/158, 159, 167, 161.17; 221/45, 46, 64, 221/67
See application file for complete search history.

(56) References Cited

U.S. PATENT DOCUMENTS

| | | | | |
|---|---|---|---|---|
| 2,670,473 | A * | 3/1954 | Stebic | 2/159 |
| 3,384,083 | A * | 5/1968 | Cozza et al. | 604/292 |
| 4,845,781 | A * | 7/1989 | Strickland et al. | 2/161.6 |
| 4,953,781 | A * | 9/1990 | Bryan | 229/125.11 |
| 5,649,336 | A | 7/1997 | Finch et al. | |
| 5,816,440 | A * | 10/1998 | Shields et al. | 221/45 |
| 5,878,909 | A | 3/1999 | Rogow | |
| 5,921,434 | A | 7/1999 | Bitran et al. | |
| 6,375,034 | B1 * | 4/2002 | Corbett | 221/46 |
| 6,488,175 | B2 * | 12/2002 | Shiffler et al. | 221/47 |
| 6,901,723 | B2 * | 6/2005 | Jordan et al. | 53/429 |
| 7,635,067 | B1 | 12/2009 | Flynn | |
| 8,684,226 | B2 * | 4/2014 | Lien | 221/45 |
| 2004/0221367 | A1 | 11/2004 | Darrow | |
| 2008/0190954 | A1 | 8/2008 | Kooyman | |
| 2009/0064392 | A1 * | 3/2009 | Rachuba et al. | 2/158 |
| 2011/0062179 | A1 * | 3/2011 | Stollery et al. | 221/45 |
| 2013/0067637 | A1 * | 3/2013 | Lin et al. | 2/167 |

* cited by examiner

*Primary Examiner* — Robyn Doan

(74) *Attorney, Agent, or Firm* — RG Patent Consulting, LLC; Rachel Gilboy

(57) ABSTRACT

A flushable disposable glove system having flushable disposable gloves to cover a hand of a user-wearer having at least one securer to prevent the flushable disposable glove from unwanted displacement; and at least one container having a pull-up raised top section with fanned, accordion-style walls, a base, a front side, a back side, a left side, a right side, and an interior volume. The flushable disposable gloves are stored and dispensed from the container. The flushable disposable glove is removably placable on a left hand and a right hand prior to urinating or defecating. The flushable disposable glove protects the hand of the user-wearer while cleaning a genital region after urinating and defecating thereby preventing the user-wearer from getting urine and feces on the hand of the user-wearer.

2 Claims, 5 Drawing Sheets

SPECIAL FLUSHABLE DISPOSABLE GLOVES SYSTEMS

CROSS-REFERENCE TO RELATED APPLICATION

The present application is related to and claims priority from prior provisional application Ser. No. 61/814,451, filed Apr. 22, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of sanitary hand covering devices and more specifically relates to a flushable disposable glove to protect a user-wearer's hands from urine and feces while cleaning themselves after using the bathroom.

2. Description of the Related Art

A glove is a garment covering the whole hand. Gloves have separate sheaths or openings for each finger and the thumb. Gloves protect and comfort hands against cold or heat, damage by friction, abrasion or chemicals, and disease; or in turn to provide a guard for what a bare hand should not touch. Latex, nitrile rubber or vinyl disposable gloves are often worn by health care professionals as hygiene and contamination protection measures.

Unfortunately, it may prove difficult for disabled people, children, and the elderly to clean themselves after using the bathroom without help from a caregiver or relative. Rather than for-go their privacy and independence, many individuals try to clean themselves on their own, spreading urine and feces onto their hands or clothing. This is not desirable in the interest of individual and public health.

Various attempts have been made to solve the above-mentioned problems such as those found in U.S. Patent and U.S. Publication Nos. 2008/0190954; 2004/0221367; U.S. Pat. Nos. 7,635,067; 5,921,434; 5,878,909; and 5,649,336. This art is representative of sanitary hand covering devices. None of the above inventions and patents, taken either singly or in combination, is seen to describe the invention as claimed.

Ideally, a flushable disposable glove system should be user-friendly and safe in-use and, yet would operate reliably and be manufactured at a modest expense. Thus, a need exists for a flushable disposable glove system to protect a user-wearer's hands from urine and feces while cleaning themselves after using the bathroom which is flushable down a toilet to prevent odors from accumulating in the trashcan and to avoid the above-mentioned problems.

BRIEF SUMMARY OF THE INVENTION

In view of the foregoing disadvantages inherent in the known sanitary hand covering devices art, the present invention provides a novel flushable disposable glove system. The general purpose of the present invention, which will be described subsequently in greater detail is to provide a flushable disposable glove system to protect a user-wearer's hands from urine and feces while cleaning themselves after using the bathroom and is flushable down a toilet to prevent odors from accumulating in the trashcan.

A flushable disposable glove system is disclosed herein comprising at least one flushable disposable glove to cover a hand of a user-wearer having at least one securer to prevent the flushable disposable glove from unwanted displacement; and at least one container having a pull-up raised top section with fanned, accordion-style walls, a base, a front side, a back side, a left side, a right side, and an interior volume. The at least one flushable disposable glove is stored and dispensed from the container (at a time). The flushable disposable glove is removably placable on a left hand and a right hand prior to urinating or defecating. The securer comprises at least one elastic band for tensionably-securing the flushable disposable glove around a wrist of said user-wearer. The flushable disposable glove protects the hand of the user-wearer while cleaning a genital region after urinating and defecating thereby preventing the user-wearer from getting urine and feces on the hand of the user-wearer.

The flushable disposable glove provides a disabled user-wearer with privacy and a sense of independence by permitting the user-wearer to urinate and defecate without assistance. The flushable disposable glove flushes down a toilet to prevent odors from accumulating in a trashcan. The flushable disposable glove may comprise at least one scent. The at least one scent preferably masks the smell of bodily fluids such as urine, feces, and blood. The flushable disposable glove further comprises at least one disinfectant in preferred embodiments.

The parameters of the novel container are defined by the pull-up raised top section with fanned, accordion-style walls, the base, the front side, the back side, the left side, and the right side thereby providing the interior volume, the interior volume accessible via the pull-up raised top section. The container is preferably rectangular-cuboid in shape. The container further comprises at least one handle located on the top section for ease of transporting the container.

The pull-up raised top section comprises a hollow interior. The pull-up raised top section further comprises at least one oval-shaped opening. The oval-shaped opening permits the user-wearer to insert the hand into the oval-shaped opening to slide the glove onto a left (or right) hand of the user-wearer. The oval-shaped opening permits the user-wearer to insert the hand into the oval-shaped opening to slide the glove onto a right hand of the user-wearer via static electricity. The pull-up raised top section is movable from a raised position when access to the oval-shaped opening is needed via the fanned, accordion-style walls to a lowered flat position when not in-use. The flushable disposable glove is able to be placed in a stacked-leafed-together sequential arrangement. The stacked-leafed-together sequential permits the user-wearer to insert the hand into oval-shaped opening to pull the flushable disposable glove out of the container and another flushable disposable glove will be sequentially pulled upwardly ready for use.

A kit is also described herein for manufacture and for sale of the flushable disposable glove system including a plurality of the flushable disposable gloves in various sizes, designs, and colors; a container for the flushable disposable gloves; and a set of user instructions.

A method of use for a flushable disposable glove system comprises the steps of: opening a container; inserting a left hand into an oval-shaped opening to slide the flushable disposable glove onto the left hand; inserting a right hand into an oval-shaped opening to slide the flushable disposable glove onto the right hand; a user-wearer sitting on a toilet to urinate and defecate; the user wearer cleaning themselves once finished urinating and defecating; removing the glove from the left hand and placing in the toilet; removing the glove from the right hand and placing in the toilet; and flushing the toilet.

The present invention holds significant improvements and serves as a flushable disposable glove system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, flushable disposable glove system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to sanitary hand covering devices and more specifically relates to a flushable disposable glove system to protect a user-wearer's hands from urine and feces while cleaning themselves after using the bathroom and is flushable down a toilet to prevent odors from accumulating in the trashcan.

Generally speaking, the special flushable disposable gloves (flushable disposable glove system) of the present invention preferably affords people protection against feces, urine, and other germs when cleaning themselves after using the bathroom. This innovative product may comprise a disposable pair of gloves that can be flushed down the toilet after use without clogging the plumbing. The gloves can either flare out at the end or secure around the wrist with drawstrings or an elastic band. The gloves can be offered in a variety of sizes, including small, medium, large, extra-large, and children sizes, and can be offered in a wide range of styles, colors, and designs to accommodate all users. Optionally, the gloves may be scented and may have an embedded disinfectant in preferred embodiments.

The gloves can be packaged in a uniquely designed dispensing container. The container can be rectangular in shape and can have a pull-up raised section with fanned, accordion-style walls and a handle on top. On the front panel of the raised section can be an oval-shaped opening. The gloves can be stacked inside the container in such a way that the top glove adheres to the underside of the raised section. When people lift up the section, the glove will automatically open for convenient placement onto the hand. The individual can then stick their hand through the oval-shaped opening, sliding their hand into the glove.

Figure 1:
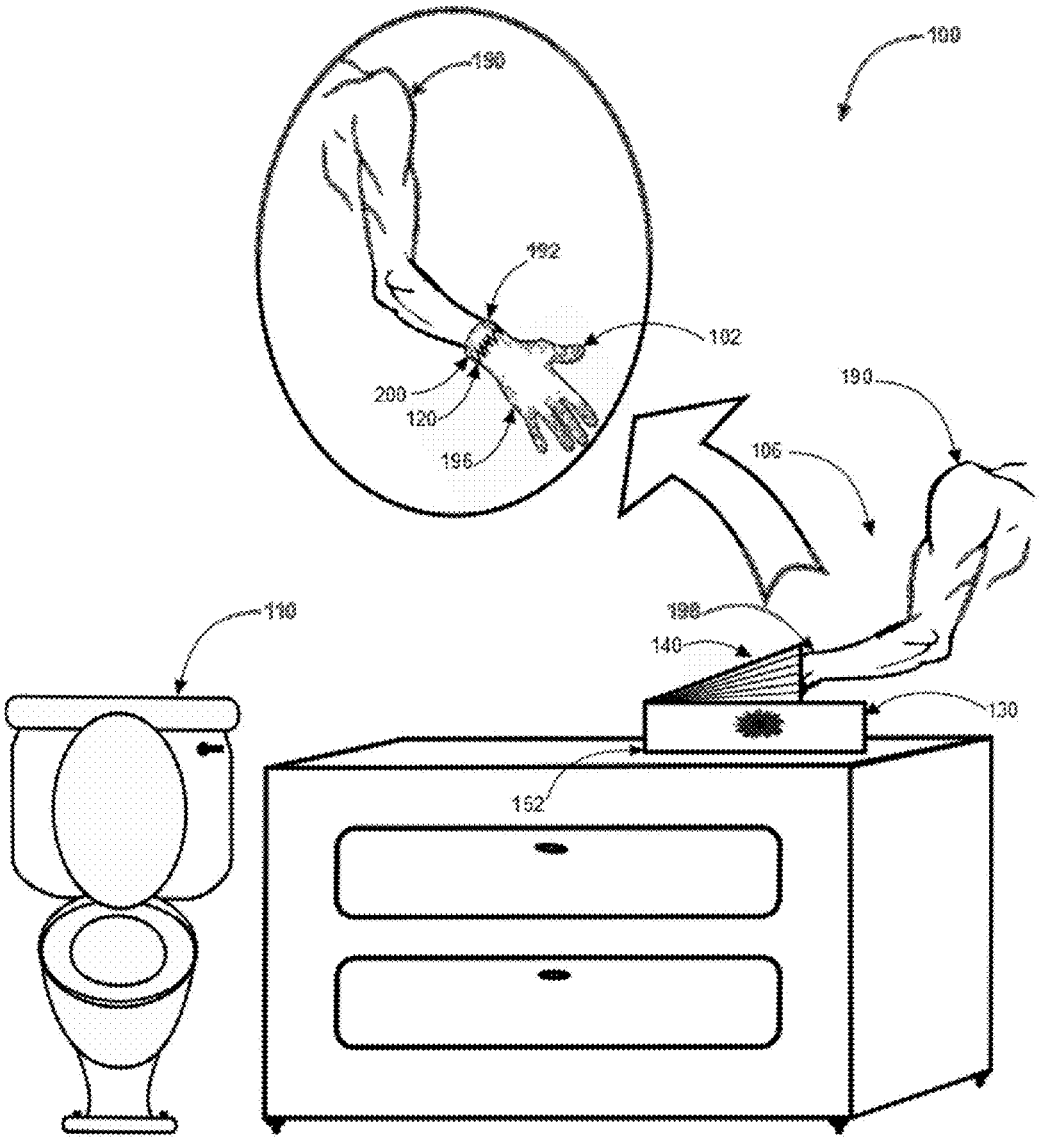
FIG. 1 shows a perspective view illustrating a flushable disposable glove system in an in-use condition according to an embodiment of the present invention.

Referring to the drawings by numerals of reference there is shown in FIG. 1 a perspective view illustrating flushable disposable glove system 100 in in-use condition 106 according to an embodiment of the present invention.

Flushable disposable glove system 100 comprises at least one flushable disposable glove 102 to cover hand 194 of user-wearer 190 having at least one securer 120 to prevent flushable disposable glove 102 from unwanted displacement; and at least one container 130 having pull-up raised top section 140 with fanned, accordion-style walls 148, base 152, front side 160, back side 166, left side 172, right side 178, and interior volume 184. At least one flushable disposable glove 102 is stored and dispensed from container 130. Flushable disposable glove 102 is preferably removably-placeable on left hand 196 and right hand 198 prior to urinating or defecating. Flushable disposable glove 102 protects hand 194 of user-wearer 190 while cleaning a genital region after urinating and defecating thereby preventing user-wearer 190 from getting urine and feces on hand 194 of user-wearer 190.

Flushable disposable glove 102 provides a disabled user-wearer 190 with privacy and a sense of independence by permitting user-wearer 190 to urinate and defecate without assistance. Flushable disposable glove 102 preferably flushes down toilet 110 (is biodegradable) to prevent odors from accumulating in a trashcan. Flushable disposable glove 102 may comprises at least one scent. The at least one scent preferably masks the smell of bodily fluids such as urine, feces, and blood. Flushable disposable glove 102 may further comprises at least one disinfectant that is not irritating to users. The disinfectant may include (be selected from the group consisting of) alcohols, aldehydes, oxidizing agents, and phenolics. Those with ordinary skill in the art will now appreciate that upon reading this specification and by their understanding the art of providing biodegradable, scented and disinfectant-infused gloves as described herein, methods of production and use of such gloves will be understood by those knowledgeable in such art.

Figure 2A:
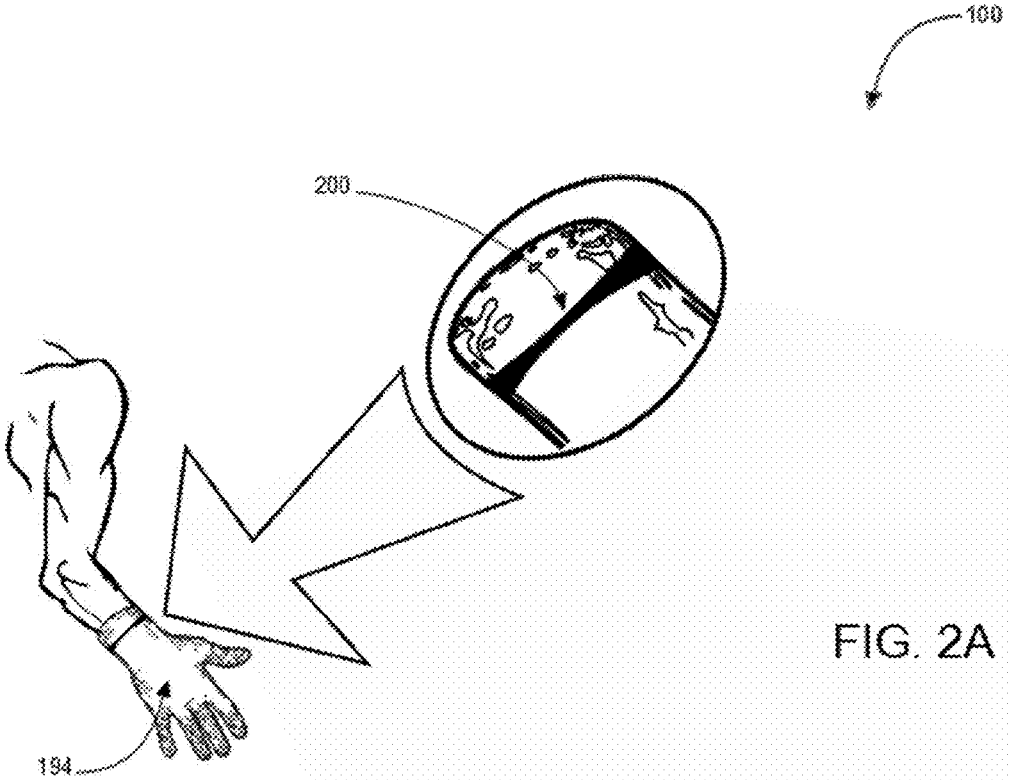
FIG. 2A is a perspective view illustrating a flushable disposable glove comprising at least one securer of the flushable disposable glove system according to an embodiment of the present invention of FIG. 1.

Referring now to FIG. 2A is a perspective view illustrating flushable disposable glove 102 comprising at least one securer 120 of flushable disposable glove system 100 according to an embodiment of the present invention of FIG. 1.

Securer 120 preferably comprises at least one elastic band 200 for tensionably-securing flushable disposable glove 102 around wrist 192 of user-wearer 190. Securer 120 comprises at least one elastic band 200 for tensionably-securing flushable disposable glove 102 around wrist 192 of user-wearer 190 as shown in FIG. 2A. In an alternate embodiment, securer 120 may comprises at least one drawstring for securing flushable disposable glove 102 around wrist 192 of user-wearer 190 (not shown). Other suitable securing means may be employed.

Figure 2B:
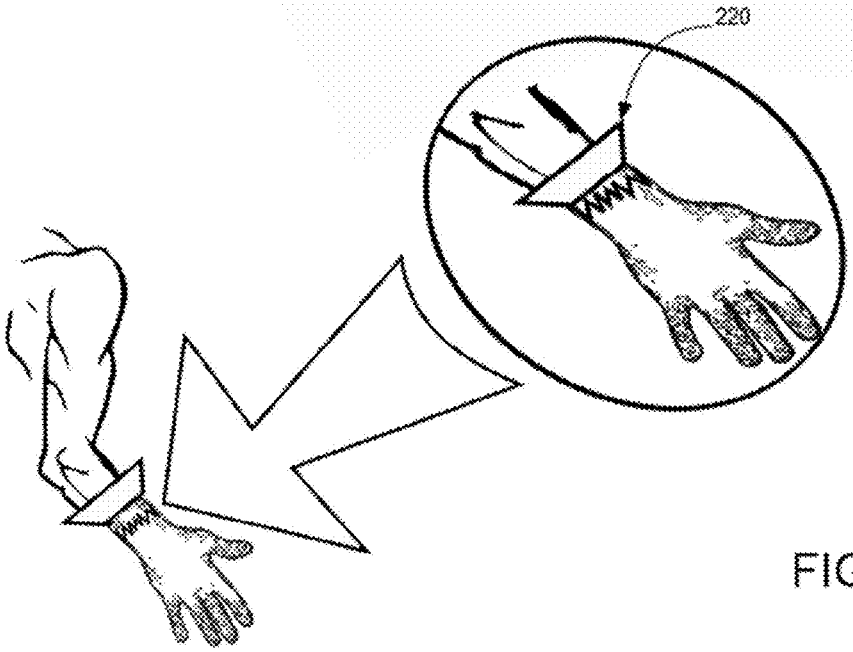
FIG. 2B is a perspective view illustrating a flushable disposable glove flaring out to prevent unwanted displacement of the flushable disposable glove system according to an embodiment of the present invention of FIG. 1.

Referring now to FIG. 2B is a perspective view illustrating flushable disposable glove 102 flaring out 220 to prevent unwanted displacement of flushable disposable glove system 100 according to an embodiment of the present invention of FIG. 1.

In another embodiment flushable disposable glove 102 may flare out 220 to prevent flushable disposable glove 102 from unwanted displacement. This feature serves to avoid splash and unwanted debris from getting onto the user.

Figure 3:
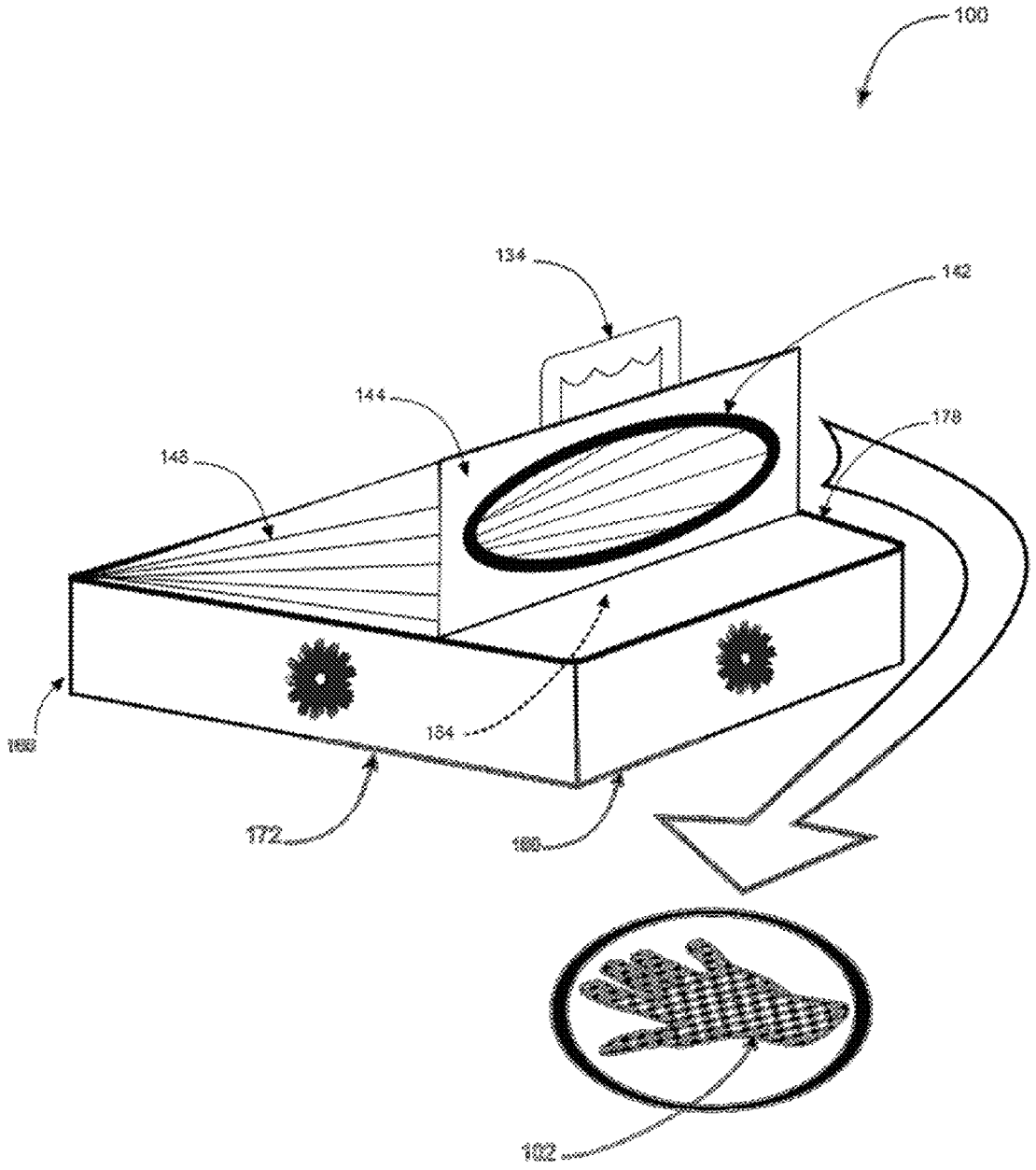
FIG. 3 is a front perspective view illustrating the flushable disposable gloves as dispensed from a container of the flushable disposable glove system according to an embodiment of the present invention of FIG. 1.

Referring now to FIG. 3 a front perspective view illustrating flushable disposable gloves 102 as dispensed from container 130 of flushable disposable glove system 100 according to an embodiment of the present invention of FIG. 1.

The parameters of container 130 are defined by pull-up raised top section 140 with fanned, accordion-style walls 148, base 152, front side 160, back side 166; left side 172, and right side 178 thereby providing interior volume 184, interior volume 184 accessible via pull-up raised top section 140. Container 130 is preferably rectangular-cuboid in shape. Container 130 further comprises at least one handle 134 located on top section 140 for ease of transporting container 130.

Pull-up raised top section 140 comprises a hollow interior. Pull-up raised top section 140 further comprises at least one oval-shaped opening 142. Oval-shaped opening 142 permits user-wearer 190 to insert hand 194 into oval-shaped opening 142 to slide glove 102 onto left hand 196 or right hand 198 of user-wearer 190. This feature promotes ease of use for inserting hand(s) into gloves without having to hold open container 130 or hold glove 102 with other available (or not available) hand.

Figure 4:
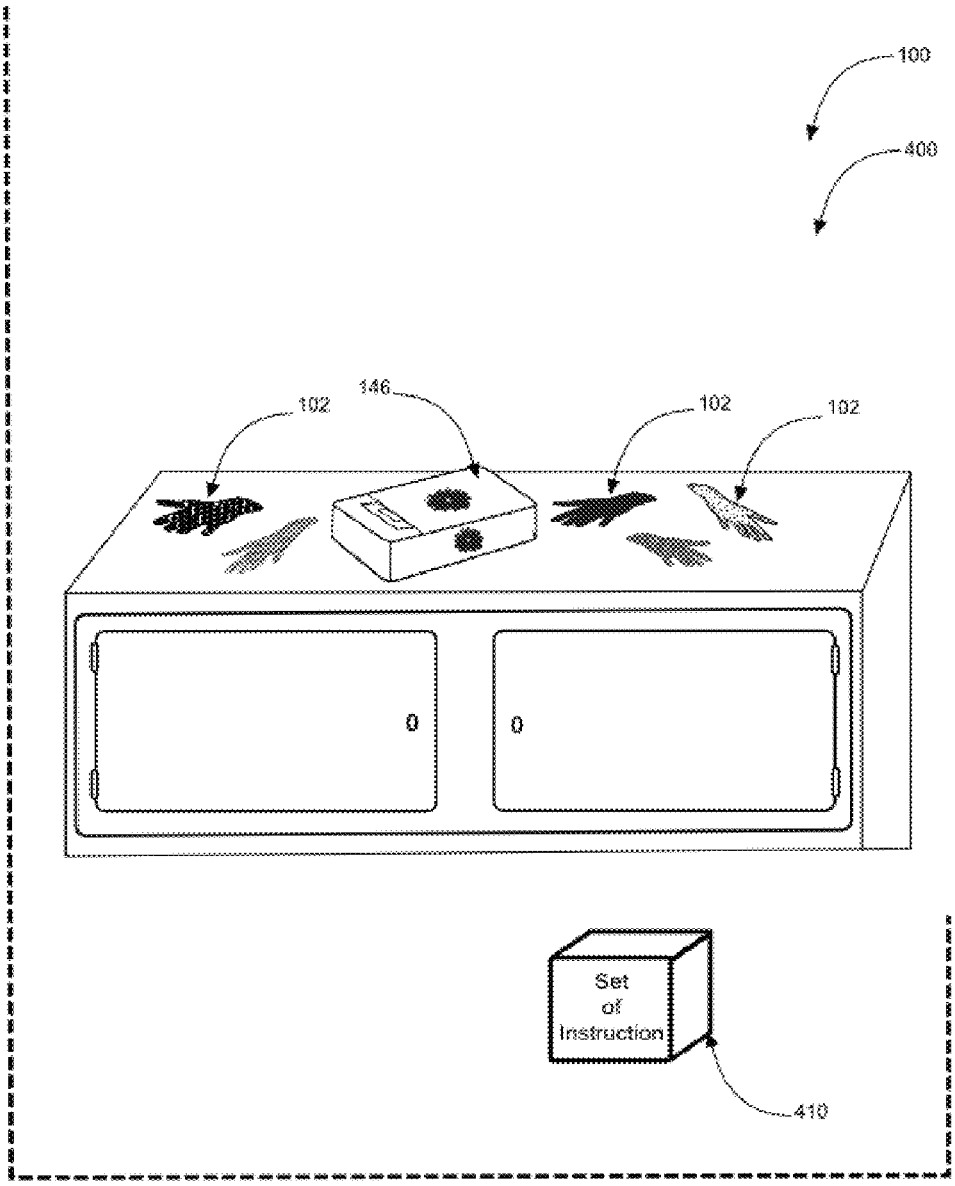
FIG. 4 is perspective view illustrating a kit of the flushable disposable glove system according to an embodiment of the present invention of FIG. 1.

Oval-shaped opening 142 permits user-wearer 190 to insert hand 194 into oval-shaped opening 142 to slide glove 102 onto left hand 196 or right hand 198 of user-wearer 190 via static electricity. Pull-up raised top section 140 is movable from raised position 144 when access to oval-shaped opening 142 is needed via the fanned, accordion-style walls 148 to lowered flat position 146 when not in-use as shown in FIG. 4. Flushable disposable glove 102 is able to be placed in a stacked-leafed-together sequential arrangement. The stacked-leafed-together sequential permits user-wearer 190 to insert hand 194 into oval-shaped opening 142 to pull flushable disposable glove 102 out of container 130 and another flushable disposable glove 102 will be sequentially pulled upwardly ready for use.

Referring now to FIG. 4 illustrating a perspective view of kit 400 of flushable disposable glove system 100 according to an embodiment of the present invention of FIG. 1.

Kit 400 for manufacture and for sale of flushable disposable glove system 100 includes a plurality of flushable disposable gloves 102 in various sizes, designs, and colors; container 130 for flushable disposable gloves 102; and a set of user instructions 410. It should be noted that kit 400 may come with plurality of the flushable disposable gloves 102 in different scents and disinfectants.

Kit 400 has instructions such that functional relationships are detailed in relation to the structure of the invention (such that the invention can be used, maintained, or the like in a preferred manner). Flushable disposable glove system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, different scent combinations, parts may be sold separately, etc., may be sufficient.

Figure 5:
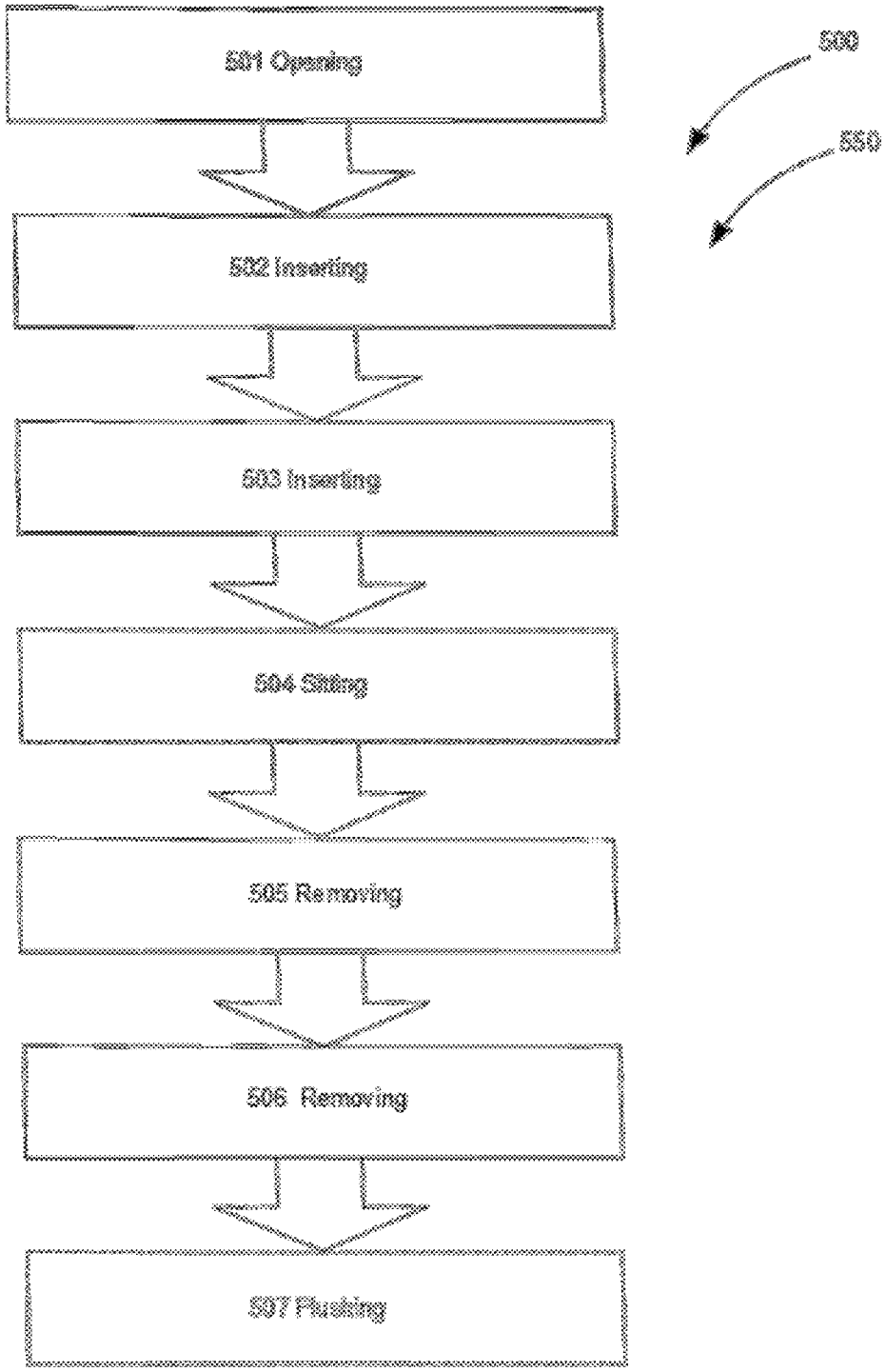
FIG. 5 is a flowchart illustrating a method of use for the flushable disposable glove system according to an embodiment of the present invention of FIGS. 1-4.

Referring now to FIG. 5, flowchart 550 illustrating method of use 500 for flushable disposable glove system 100 according to an embodiment of the present invention of FIGS. 1-4.

Method of use 500 of flushable disposable glove system 100 preferably comprises the steps of: step one 501 opening container 130; step two 502 inserting left hand 196 into oval-shaped opening 142 to slide flushable disposable glove 102 onto left hand 196; step three 503 inserting right hand 198 into oval-shaped opening 142 to slide flushable disposable glove 102 onto right hand 198; step four 504 user-wearer 190 sitting on toilet 110 to urinate and defecate; step five 505 user-wearer 190 cleaning themselves once finished urinating and defecating; step six 506 removing glove 102 from left hand 196 and placing in toilet 110; step seven 507 removing glove 102 from right hand 198 and placing in toilet 110; and step eight 508 flushing toilet 110.

It should be noted that the steps described in the method of use can be carried out in many different orders according to user preference. The use of "step of" should not be interpreted as "step for", in the claims herein and is not intended to invoke the provisions of 35 U.S.C. §112, 916. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A flushable disposable glove system comprising:

at least one flushable disposable glove to cover a hand of a user-wearer having, at least one securer to prevent said flushable disposable glove from unwanted displacement; and at least one container having;

a pull-up raised top section with fanned, accordion-style walls;

a base;

a front side;

a back side;

a left side;

a right side; and an interior volume;

wherein said at least one flushable disposable glove is stored and dispensed from said container;

wherein said flushable disposable glove is removably placable on a left said hand and a right said hand prior to urinating or defecating;

wherein said flushable disposable glove protects said hand of said user-wearer while cleaning a genital region after said urinating and said defecating thereby preventing said user-wearer from getting said urine and feces on said hand;

wherein said flushable disposable glove further comprises at least one scent;

wherein said flushable disposable glove further comprises at least one disinfectant;

wherein said securer comprises at least one elastic band for tensionably-securing said flushable disposable glove around a wrist of said user-wearer;

wherein said flushable disposable glove provides a disabled said user-wearer with privacy and a sense of independence by permitting said user-wearer to said urinate and said defecate without assistance;

wherein said flushable disposable glove flushes down a toilet to prevent odors from accumulating in a trashcan;

wherein parameters of said container are defined by said pull-up raised top section with fanned, said accordion-style walls, said base, said front side, said back side; said left side, and said right side thereby providing said interior volume, said interior volume accessible via said pull-up raised top section;

wherein said container is rectangular-cuboid in shape;

wherein said container further comprises at least one handle located on said top section for ease of transporting said container;

wherein said pull-up raised top section comprises a hollow interior;

wherein said pull-up raised top section further comprises at least one oval-shaped opening;

wherein said oval-shaped opening permits said user-wearer to insert said hand into said oval-shaped opening to slide said glove onto a left said hand of said user-wearer;

wherein said oval-shaped opening permits said user-wearer to insert said hand into said oval-shaped opening to slide said glove onto a right said hand of said user-wearer via static electricity;

wherein said pull-up raised top section is movable from a raised position when access to said oval-shaped opening is needed via said fanned, accordion-style walls to a lowered flat position when not in-use;

wherein said flushable disposable glove are able to be placed in a stacked-leafed-together sequential arrangement; and wherein said stacked-leafed-together sequential permits said user-wearer to insert said hand into oval-shaped opening to pull said flushable disposable glove out of said container and another said flushable disposable glove will be sequentially pulled upwardly ready for use.

2. The flushable disposable glove system of claim 1 further comprising a kit, wherein said kit comprises: a plurality of said flushable disposable gloves in various sizes, designs, and colors; a container for storing said flushable disposable gloves; and a set of user instructions.

* * * * *